US007784716B2

(12) United States Patent
Fukutomi et al.

(10) Patent No.: US 7,784,716 B2
(45) Date of Patent: Aug. 31, 2010

(54) FUEL INJECTION VALVE AND METHOD FOR MANUFACTURING SWIRLER

(75) Inventors: Norihisa Fukutomi, Tokyo (JP); Mamoru Sumida, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 240 days.

(21) Appl. No.: 11/017,704

(22) Filed: Dec. 22, 2004

(65) Prior Publication Data

US 2005/0139699 A1 Jun. 30, 2005

(30) Foreign Application Priority Data

Dec. 25, 2003 (JP) ..... 2003-428577

(51) Int. Cl.
*F02M 61/00* (2006.01)

(52) U.S. Cl. ..... 239/533.12; 239/463; 239/468; 239/486; 239/487; 239/489; 239/494

(58) Field of Classification Search ..... 239/463, 239/468–473, 486, 487, 533.12, 466, 488, 239/489, 494, 496, 483, 497, 501, 596, 599
See application file for complete search history.

(56) References Cited

U.S. PATENT DOCUMENTS 2,503,481 A * 4/1950 Hallinan ..... 239/462
3,112,074 A * 11/1963 Green ..... 239/493
5,871,157 A 2/1999 Fukutomi et al.
5,915,352 A 6/1999 Okamoto et al.
5,979,801 A * 11/1999 Munezane et al. ..... 239/533.12
6,382,533 B1 * 5/2002 Mueller et al. ..... 239/585.1
6,439,482 B2 * 8/2002 Hosoyama et al. ..... 239/463
6,845,748 B2 1/2005 Kobayashi et al.

FOREIGN PATENT DOCUMENTS

| | | | |
|---|---|---|---|
| DE | 197 40 026 | A1 | 8/1998 |
| EP | 1 327 771 | A2 | 7/2003 |
| EP | 1 335 127 | A2 | 8/2003 |
| JP | 02241972 | | 9/1990 |
| JP | 2577046 | B2 | 11/1996 |
| JP | 9-126088 | A | 5/1997 |
| JP | 10-47208 | A | 2/1998 |
| JP | 10-213053 | A | 8/1998 |
| JP | 2001304076 | | 10/2001 |
| JP | 2003139017 | | 5/2003 |
| JP | 2003254194 | | 9/2003 |

* cited by examiner

*Primary Examiner*—Len Tran
*Assistant Examiner*—Jason J Boeckmann
(74) *Attorney, Agent, or Firm*—Sughrue Mion, PLLC

(57) ABSTRACT

A valve seat 14 having an injection hole 14*b* is fixed at one end of a hollow valve main body 15, a valve body 12 slidably supported so as to be separated from and brought into contact with the valve seat 14 to open and close the injection hole 14*b* and a swirler 16 for surrounding the valve body 12 to slidably support the valve body 12 and for imparting a swirling motion to fuel flowing into the injection hole 14*b* are equipped, a swirling groove 16*b* in the swirler 16 includes a curvature part 16*b*3 in a groove outlet, and a sectional configuration of the swirling groove 16*b* is constituted so that the depth of the central part is larger than the depth of the end part.

1 Claim, 8 Drawing Sheets

FUEL INJECTION VALVE AND METHOD FOR MANUFACTURING SWIRLER

BACKGROUND OF THE INVENTION

1. Field of the Invention

The present invention relates to a fuel injection valve for cylinder injection and, more particularly, to a fuel injection valve which imparts swirling energy to a fuel flow by a swirling means, and injects a fuel from a fuel injection hole.

2. Description of the Related Art

In the conventional fuel injection valve, outlets of downstream of swirling grooves are opened around a general whole circumference of a inner circumferential annular groove of a swirler, a swirling flow is generated around a whole circumference by reducing spaces between adjacent swirling grooves, and a fuel is flowed to a injection hole in downstream so that a gap of a flow is not generated (for example, see the Japanese Patent Publication (unexamined) No. 1997/47208).

Since the conventional fuel injection valve is constructed as mentioned above, six swirling grooves are disposed by equal intervals, and adjacent swirling grooves are constructed so as to have a cross angle of 60°. Therefore a problem exists in that a loss of a flow occurs, and it is not possible to promote to atomize a spray since fuel getting out of swirling grooves collide at an angle of 60° to each other.

SUMMARY OF THE INVENTION

The present invention has been made to solve the above-discussed problems and has an object to reduce a loss of a flow of a fuel injection valve, and to promote to atomize a spray. Furthermore the present invention has an object to mass-produce elaborate fuel injection valves.

A fuel injection valve of the present invention includes a hollow valve main body, a valve seat provided at one end of the valve main body and having an injection hole, a valve body slidably supported so as to be separated from and brought into contact with the valve seat to open and close the injection hole, and a swirler for surrounding the valve body to slidably support the valve body and for imparting a swirling motion to fuel flowing into the injection hole. In this fuel injection valve, a swirling groove in the swirler is provided with a curvature part in a groove outlet, and a sectional configuration of the swirling groove is constituted so that the depth of the central part is larger than the depth of the end part.

In this fuel injection valve of above construction, the loss caused by collision of fuel in the outlets of the swirling grooves is reduced, therefore it is possible to promote to atomize fuel spray, and to improve combustibility of an engine.

DESCRIPTION OF THE PREFERRED EMBODIMENTS

Embodiment 1

An embodiment according to this invention is hereinafter described referring to the accompanying drawings.

Figure 1:
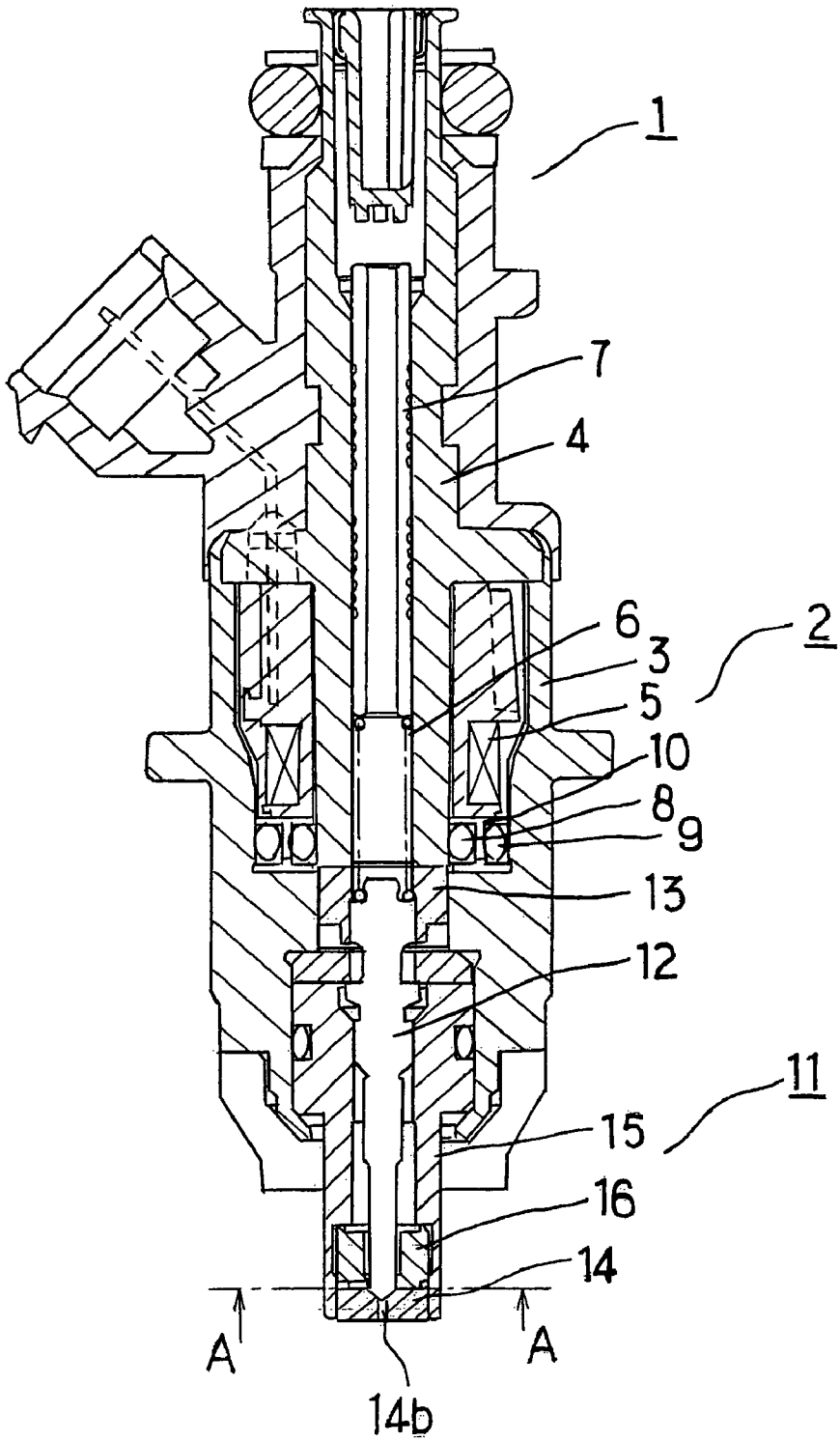
FIG. 1 is a sectional view showing a fuel injection valve according to Embodiment 1 of the present invention.
Figure 2:
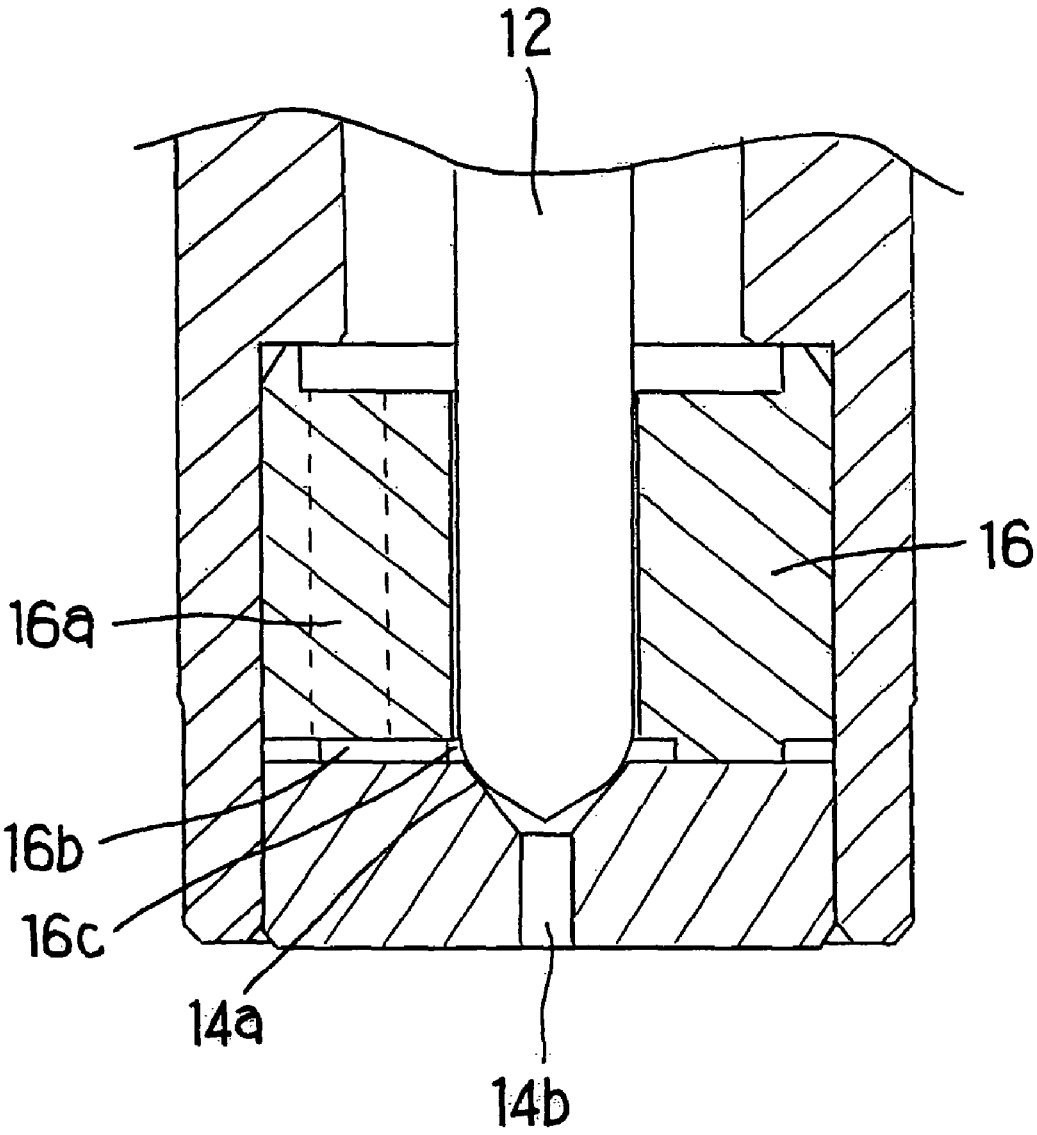
FIG. 2 is a sectional view showing a end part of the fuel injection valve.
Figure 3:
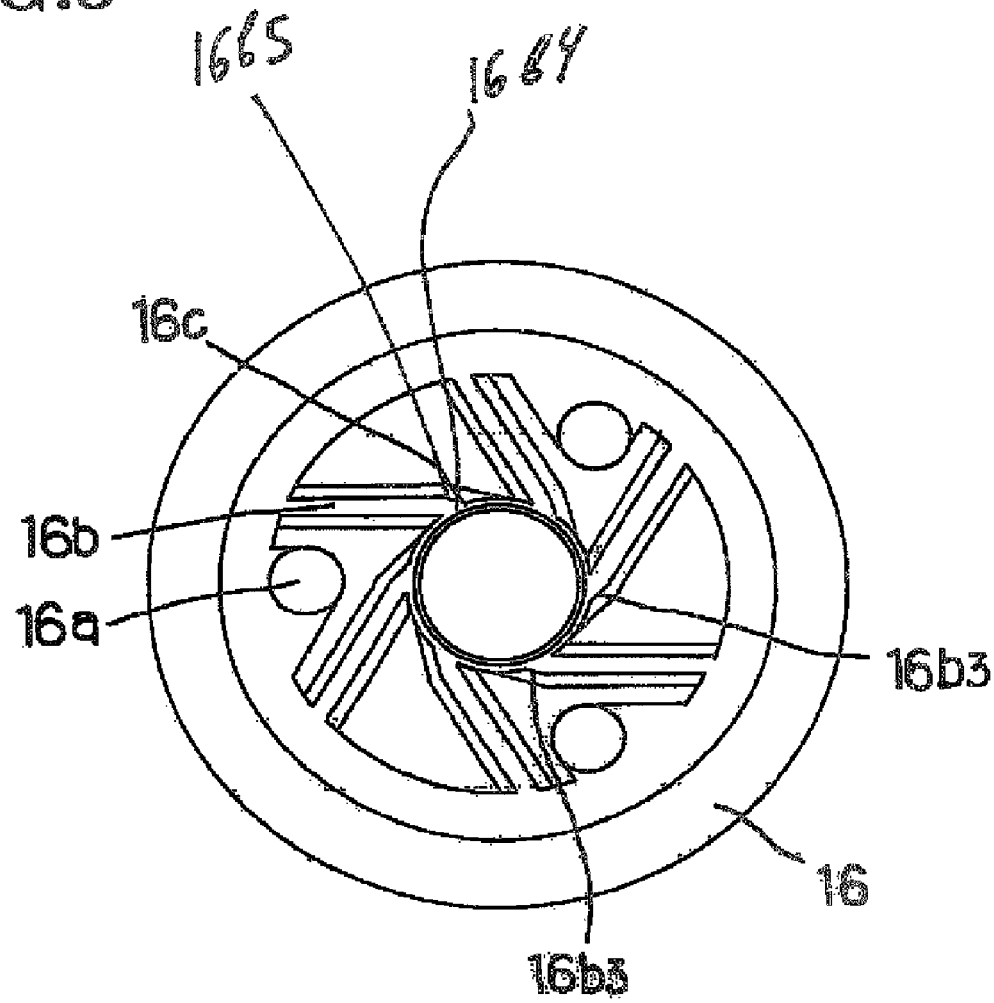
FIG. 3 is a sectional view taken along the line A-A of FIG. 1.
Figure 4:
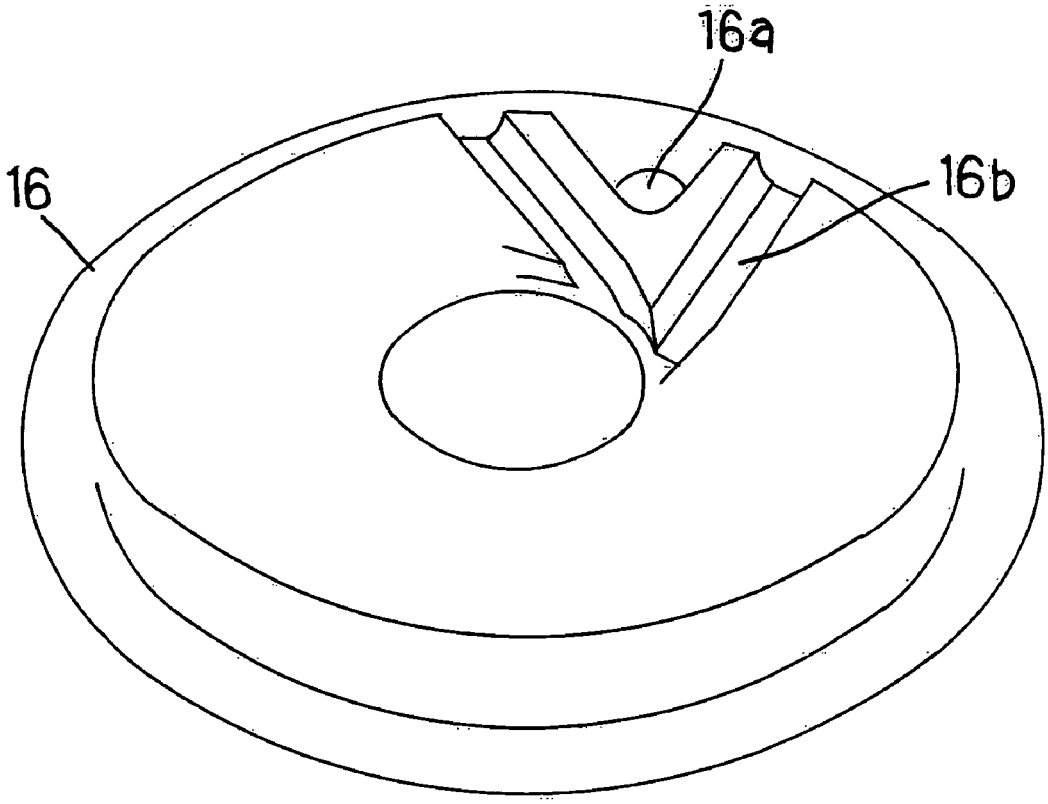
FIG. 4 is a perspective view taken in a bottom face of a swirler.

FIG. 1 is a sectional view showing a fuel injection valve according to Embodiment 1 of the present invention, FIG. 2 is a sectional view showing a end part of the fuel injection valve, FIG. 3 is a sectional view taken along the line A-A of FIG. 1, and FIG. 4 is a perspective view taken in a bottom face of a swirler.

A fuel injection valve 1 is constituted by a solenoid device 2 and a valve device 11. The solenoid device 2 is constituted by a housing 3 serving as a yoke portion of a magnetic circuit, a stator core 4 serving as a magnetic circuit, a coil 5, a spring 6, a rod 7 fixed for adjusting a position of the spring 6, rubber rings 8, 9 for sealing a fuel, and a metal ring 10 having a seal face of the rubber rings 8, 9.

The valve device 11 is constituted by a valve body 12 being a needle valve, a movable core 13 integrally formed with the valve body 12, a valve seat 14, a hollow valve main body 15 housing the valve body 12, and a swirler 16 imparting a swirling motion to a fuel.

When an actuating signal is fed to a drive circuit of the fuel injection valve 1 from a microcomputer of an engine, a current flows in the coil 5 and a magnetic flux is generated in a magnetic loop constituted by the housing 3, the movable core 13, and the stator core 4. And the movable core 13 is attracted to the stator core 4 side by an electromagnetic attractive force beyond a pressing force of the spring 6.

The valve body 12 integrally formed with the movable core 13 is separated from a seat portion 14*a* of the valve seat 14, and a gap is formed between the valve body 12 and the seat portion 14*a*. Next a high pressure fuel more than 2 MPa is injected from an injection hole 14*b* of the valve seat 14, an injection of a fuel is started. When a current is not fed to the coil 5, the valve body 12 comes in contact with the seat portion 14*a*, and an injection is finished.

A fuel is fed from the upper portion of the fuel injection valve 1, and flows into the inner part of the valve main body 15 through the inner part of the stator core 4. And a fuel gets to swirling grooves 16*b* via a through hole 16*a* of the swirler 16, and passes the seat portion 14*a*through a clearance part 16*c* being a groove outlet part between the valve body 12 and the swirler 16. Furthermore a fuel helically swirls in the injection hole 14*b*, thereafter a fuel is injected toward the outside. As depicted in FIG. 3, curvature parts 16*b*3 are curved where the grooves 16*b* meet the clearance part 16*c* i.e., the distal end portion 16*b*4. The curvature parts 16*b*3 are also curved at a portion near the distal end portion 16*b*4. As shown in FIG. 3, the curvature parts 16*b*3 are bent to form a curve 16*b*5 on one side of the groove, behind the distal end.

Figure 5:
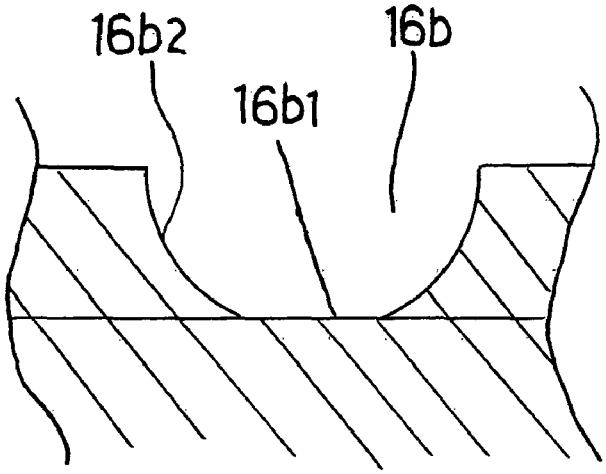
FIG. 5 is a sectional view showing a configuration of a swirling groove.

FIG. 5 is a sectional view showing a configuration of the swirling groove 16*b*. A sectional configuration of the swirling groove 16*b* is constituted so that the depth of the central part is larger than the depth of the end part.

That is, the swirling groove 16*b* is provided with a flat part 16*b*1 in the bottom face, and with an arc part 16*b*2 in its circumference, the swirling groove 16*b* is formed into a semi-circular style. The main stream of a fuel flows in the flat part 16*b*1 that is the deepest part of the swirling groove 16*b*.

In the groove outlets, the swirling grooves 16*b* are provided with curvature parts 16*b*3 folded to a direction in which the center line of the swirling groove 16*b* approaches the central axis of the swirler 16, the direction of the fuel stream is changed in accordance with transverse positions of the swirling groove 16*b*.

Figure 6:
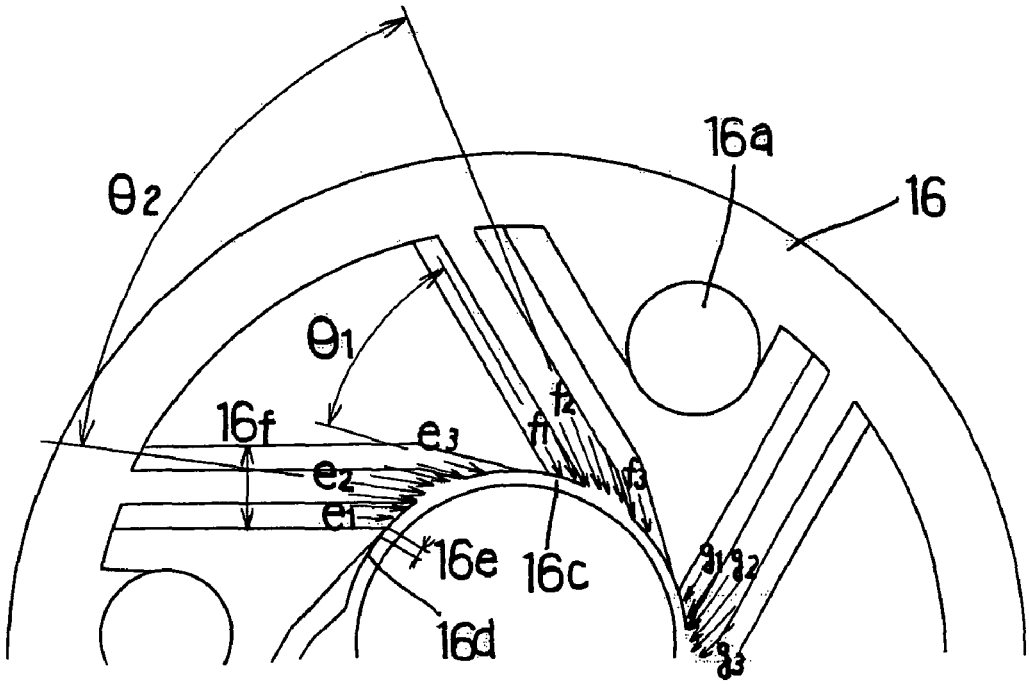
FIG. 6 is a plane view showing a swirler.

FIG. 6 is a plane view showing a state of the fuel stream in the swirling grooves 16*b*. In transverse positions of the swirling groove 16*b*, in using $e_1$ to $e_3$, $f_1$ to $f_3$, and $g_1$ to $g_3$ as elements of each fuel stream, the streams $f_1$ and $f_3$ flow in the arc part 16*b*2, the groove is shallow, and stream is slow. The stream $f_2$ flows in the flat part 16*b*1, the groove is deep, and stream is rapid. The rapid stream $f_2$ is indicated by a longer arrow than the slow streams $f_1$ and $f_3$.

The direction of stream becomes different while the position of stream is changed from $f_1$ to $f_3$, the direction of stream is changed so that the direction of the stream $f_3$ approaches the central axis of the fuel injection valve 1 in comparison with the stream $f_1$.

Outlets of the swirling grooves 16*b* are opened on the same circle 16*d*, the length of an arc part 16*e* between the swirling grooves 16*b* is set below fifth of the groove width 16*f*.

That is, by reducing the spaces between outlets of the swirling grooves 16*b*, and by possibly generating swirling stream of a fuel around the whole circumference of the same circle 16*d*, it is possible to prevent a swirling stream in circumferential direction into the below injection hole 14*b* from breaking off.

By constructing as described above, it is possible to prevent a spray from breaking off, and to improve quality of a spray. Furthermore it is possible to prevent a swirling stream from breaking off into the injection hole 14*b*, and to prevent parts in which carbon deposit is not washed from occurring.

Fuel streams getting out of adjacent swirling grooves 16*b* collide at the groove outlet parts 16*c*. However, in the present invention, the curvature parts 16*b*3 are disposed near outlets of the swirling grooves 16*b*, thereby the collision angle $\theta_1$ between directly colliding fuel stream elements $e_3$ and $f_1$ is smaller than the cross angle of the swirling grooves 16*b*, that is to say, the cross angle $\theta_2$ between stream elements $e_2$ and $f_2$. Eventually, the loss caused by collision is reduced.

In fuel stream elements $e_3$ and $f_1$, the speed of fuel stream is slow, therefore the loss caused by collision is reduced.

As described above, according to this embodiment, the loss caused by collision of fuel in the outlets of the swirling grooves 16*b* is reduced, therefore it is possible to promote to atomize fuel spray, and to improve combustibility of an engine.

Embodiment 2

Figure 7:
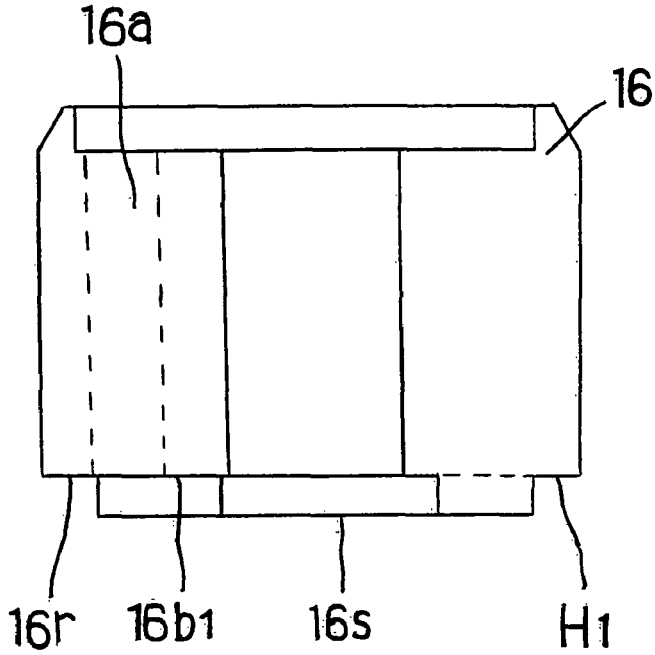
FIG. 7 is a front view showing a swirler.
Figure 8:
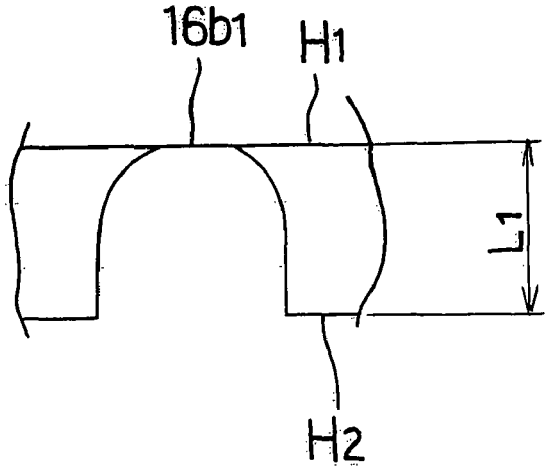
FIG. 8 is a sectional view showing a configuration of a swirling groove.
Figure 9:
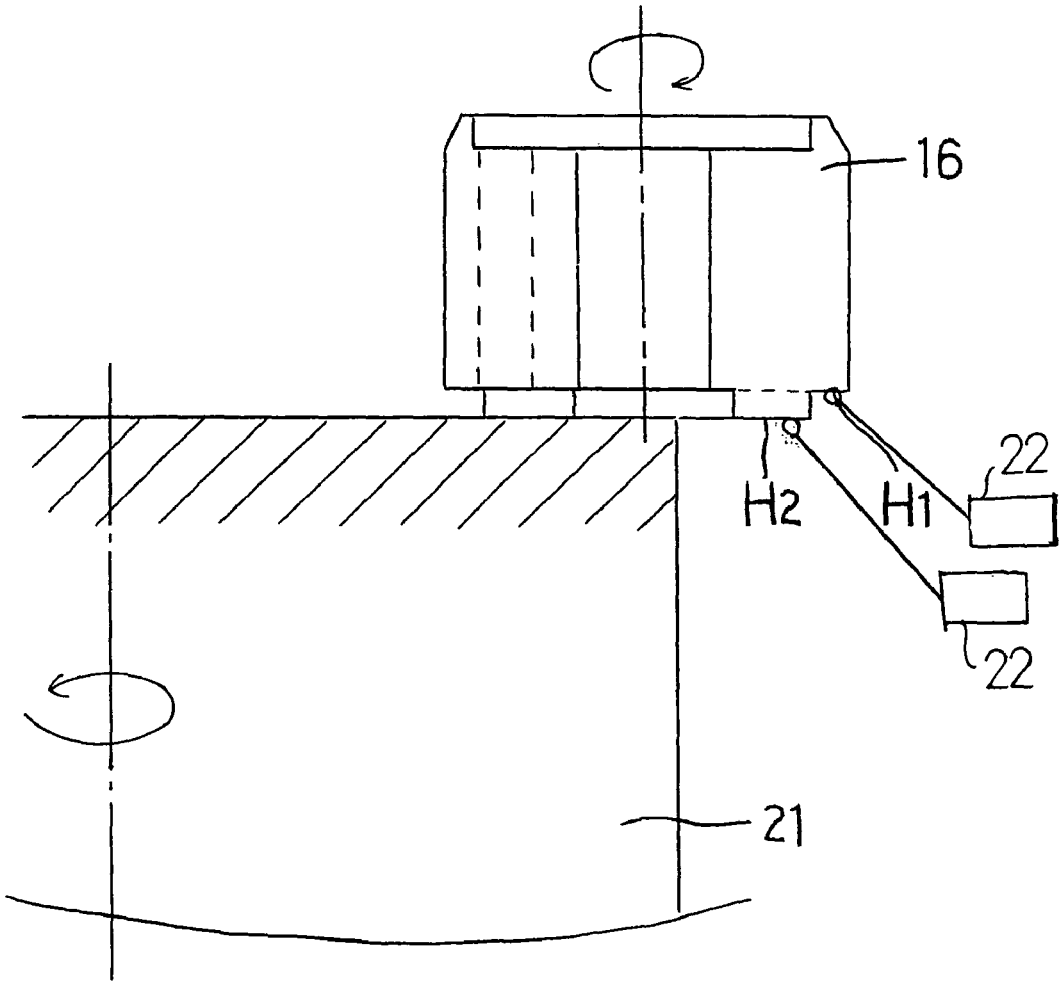
FIG. 9 is a front view showing a method for processing a end face.
Figure 10:
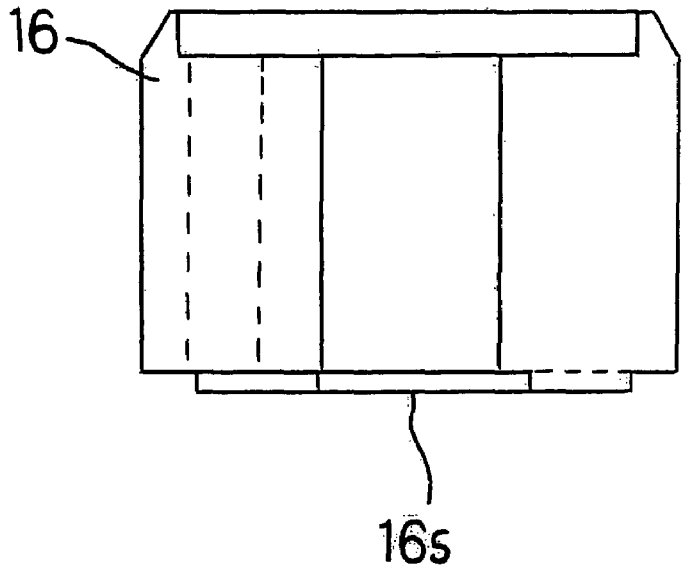
FIG. 10 is a front view showing a swirler.

In the present embodiment, the depth of the swirling groove 16*b* is finished into the predetermined depth by processing the end face of the swirler 16. FIG. 7 is a front view showing a state of the swirler 16 before processing its end face, FIG. 8 is a sectional view showing a configuration of the swirling groove 16*b* before processing. FIG. 9 is a front view showing a method for processing the end face, the end face is processed by rotating a grinder 21. FIG. 10 is a front view showing a state of the swirler 16 after processing its end face, FIG. 11 is a sectional view showing a configuration of the swirling groove 16*b* after processing.

In the drawings, in this embodiment, the height of a circular flat face 16*r* on the outer circumference side above the swirling groove 16*b* and the height of the flat part 16*b*1 are formed into the same height H1, and an end face 16*s* of the swirler 16 is ground. The height of the end face 16*s* is indicated by H2.

Figure 11:
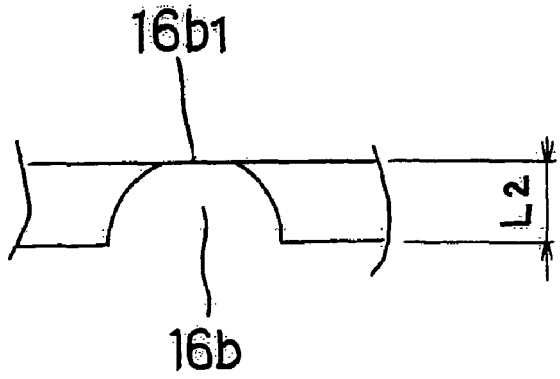
FIG. 11 is a sectional view showing a configuration of a swirling groove.

As shown in FIG. 7, the swirler 16 is formed by metal injection molding, thereafter the end face 16*s* of the swirler 16 is finished by grinding as shown in FIG. 9, subsequently the depth of the swirling groove 16*b* is formed into the aim dimension L2 of a finished product from L1 as shown in FIG. 10 and FIG. 11.

In the present invention, a configuration of the swirling groove 16*b* is constituted so that the center becomes deep, the central bottom part of the swirling groove 16*b* is provided with the flat part 16*b*1, and the flat face having the same height as the flat part 16*b*1 is formed on the outside of the swirling groove 16*b*. The flat part 16*b*1 of the swirling groove 16*b* and the circular flat face 16*r* on the outside of the swirling groove 16*b* are formed into the same flat face by using the same die.

In processing the end face 16*s*, the end face 16*s* is processed so that the depth of the swirling groove 16*b* becomes L2 from L1, however the circular flat face 16*r* on the outside of the swirling groove 16*b* is formed into the same flat face as the bottom face of the swirling groove 16*b*. Thereby the height H1 and the height H2 are measured, and the difference between H1 and H2 becomes the depth of the swirling groove 16*b*.

Therefore, when the difference between H1 and H2 becomes L2, processing the end face 16*s* is finished, the depth of the swirling groove 16*b* can become L2.

In the present invention, the circular flat face 16*r* formed into the same flat face as the flat part 16*b*1 of the swirling groove 16*b* is formed on the end face 16*s* side in which the swirling groove 16*b* is formed, and on the outer circumference side above the swirling groove 16*b*. Thereby it is possible to measure the depth of the swirling groove 16*b* by the difference between the height H1 of the circular flat face 16*r* and the height H2 of the end face 16*s*, furthermore it is possible to measure H1 and H2 while processing.

Since the swirler 16 according to the present invention is processed as mentioned above, it is possible to manufacture elaborate products by processing for a short time. In measuring the height H1 and H2, it is desirable to use a height gauge 22 or a laser height instrumentation as shown in FIG. 9. Furthermore it is desirable that the swirler 16 is formed by sintering or cold forging.

According to the present embodiment as mentioned above, it is possible to manufacture a fuel injection valve by processing for a short time, therefore it is possible to manufacture a fuel injection valve at a low cost. Furthermore it is possible to restrain dispersion of the depth of the swirling groove 16*b*, thereby it is possible to mount a fuel injection valve which hardly generates dispersion of spray on an engine, and it is possible to restrain deterioration of emission of the engine.

What is claimed is:

1. A fuel injection valve comprising:

a hollow valve main body, a valve seat provided at one end of said valve main body and having an injection hole, a valve body slidably supported so as to be separated from and brought into contact with said valve seat to open and close said injection hole, and a swirler for surrounding said valve body to slidably support said valve body and for imparting a swirling motion to fuel flowing into said injection hole;

wherein a swirling groove in said swirler is provided with a curvature part in a groove outlet, such that a distal end of said groove outlet, in a top view thereof, is curved, and a cross-sectional configuration of said swirling groove is constituted so that a bottom surface of said swirling groove is flat and entire side surfaces of said swirling groove are arc-shaped, wherein an upper surface of said swirling groove is open-ended, wherein a portion of said groove outlet, other than said distal end, is also curved in a top view thereof, and wherein a length of an arc part between said swirling groove and an adjacent swirling groove is set below a fifth of a groove width.

* * * * *